US007168755B2

(12) United States Patent
Munezane

(10) Patent No.: US 7,168,755 B2
(45) Date of Patent: Jan. 30, 2007

(54) DOOR OUTER HANDLE STRUCTURE

(75) Inventor: Kozo Munezane, Kawachi-gun (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/124,980

(22) Filed: May 9, 2005

(65) Prior Publication Data

US 2005/0253413 A1 Nov. 17, 2005

(30) Foreign Application Priority Data

May 12, 2004 (JP) ..... 2004-142440
May 12, 2004 (JP) ..... 2004-142441

(51) Int. Cl.
*B60J 5/04* (2006.01)

(52) U.S. Cl. ..... 296/152; 296/146.9; 292/336.3

(58) Field of Classification Search ..... 296/152, 296/146.9; 292/336.3
See application file for complete search history.

(56) References Cited

U.S. PATENT DOCUMENTS 2,997,336 A * 8/1961 Grant et al. ..... 296/106
4,492,405 A * 1/1985 Chikaraishi et al. ..... 296/146.9
6,827,390 B2 * 12/2004 Zummallen et al. ... 296/146.11

FOREIGN PATENT DOCUMENTS

JP 2004-027556 1/2004

* cited by examiner

*Primary Examiner*—Dennis H. Pedder
(74) *Attorney, Agent, or Firm*—Carrier, Blackman & Associates, P.C.; Joseph P. Carrier; William D. Blackman

(57) ABSTRACT

A door outer handle structure in a vehicle having a hinge type opening and closing front side door and a slide type opening and closing rear side door, includes a front outer handle secured along the longitudinal direction of the vehicle at the rear end edge of the front side door, a rear outer handle secured along the longitudinal direction of the vehicle at the front end edge of the rear side door so as to become flush with the front outer handle, a hinge portion for rotatably supporting the front part of the rear outer handle, and a retraction portion provided at least one of the facing portions where the front outer handle and the rear outer handle are opposed to each other.

7 Claims, 13 Drawing Sheets

DOOR OUTER HANDLE STRUCTURE

BACKGROUND OF THE INVENTION

1. Field of the Invention

The present invention relates to a door outer handle structure of a vehicle.

Priority is claimed on Japanese Patent Application No. 2004-142440 filed on May 12, 2004, and Japanese Patent Application No. 2004-142441 filed on May 12, 2004, the content of which is incorporated herein by reference.

2. Description of Related Art

As a door outer handle structure of a vehicle having hinge type opening and closing front side doors and slide type opening and closing rear side doors, such a type of door handle structure is available (for example, refer to Japanese Published Unexamined Patent Application No. 2004-27556), in which a front outer handle is provided at the rear portion of the front side door and a rear outer handle is provided at the front portion of the rear side door with spacing secured to the front outer handle.

In order to improve the design and appearance of the vehicle, it is preferable that the front outer handle be provided along the longitudinal direction at the rear end edge of the hinge type opening and closing front side door, and the rear outer handle is provided at the front end edge of the slide type opening and closing rear side door so as to secure alignment with the front outer handle in the longitudinal direction. In this case, since it is considered that the hinge portion for rotatably supporting the rear outer handle interferes with the door inner panel, etc., the hinge portion is disposed at the rear portion of the rear outer handle.

However, if the hinge portion of the rear outer handle is located at the rear side, it is difficult to execute especially a closing operation in the slide type opening and closing rear side door. That is, an operation for closing the rear side door using the rear outer handle disengages the latch mechanism by pulling the rear outer handle in the rearward direction, which becomes reverse of the door closing direction which is the same as the forward direction of a vehicle. In almost all the vehicles, the above-described operation is carried out after a passenger gets out of a vehicle. However, since the getting-out position of a passenger is almost fixed, it is difficult for the passenger who got out to execute an operation of turning the rear outer handle of the rear side door, which is located rearward of the getting-out position, in a state where the passenger stands at the getting-out position. Therefore, it is necessary for the passenger to move one or two steps rearward at all times, where the passenger feels dissatisfaction in that it is difficult to carry out a closing operation of the rear side door.

SUMMARY OF THE INVENTION

It is an object of the invention to provide a door outer handle structure by which the rear side door can be easily closed, and which does not interfere with the door inner panel, etc.

A door outer handle structure according to the invention is a door outer handle structure provided in a vehicle having hinge type opening and closing front side doors and slide type opening and closing rear side doors, which includes: a front outer handle secured at the rear end edge of the front side door along the longitudinal direction of the vehicle; a rear outer handle provided at the front end edge of the rear side door to secure alignment with the front outer handle along the longitudinal direction of the vehicle; a hinge portion rotatably supporting the front portion of the rear outer handle; and a retraction portion provided at at least one of opposed portions where the front outer handle and rear outer handle are opposed to each other.

According to the door outer handle structure according to the invention, since the hinge portion rotatably supports the front part of the rear outer handle, an operation of closing the rear side door can be facilitated. That is, since a passenger who gets out of the vehicle can turn the rear outer handle of the rear side door located rearward of the getting-out position as the passenger stands at the getting-out position, it is possible for the passenger to close the rear side door without moving rearward. Therefore, an operation of closing the rear side door can be easily carried out.

On the other hand, since the hinge portion rotatably supports the front part of the rear outer handle, a passenger can easily hang onto the front part of the rear outer handle by hand when closing the rear side door. However, since a retraction portion is provided at at least one of the opposed portions where the front outer handle and the rear outer handle are opposed to each other, it is possible to prevent the hand hanging onto the front part of the rear outer handle from being brought into collision with the front outer handle even if the rear side door is subjected to overstroke when closing the rear side door.

In the door outer handle structure according to the invention, it is preferable that the retraction portion be a tapered portion provided at at least one of the opposed portions. According to the invention, since the tapered portion which is the retraction portion is well matched to the appearance of a vehicle, there is no sense of incongruity. Therefore, the design of the entire vehicle is not spoiled, wherein the appearance of the vehicle can be improved.

In the door outer handle structure according to the invention, it is preferable that the tapered portion be provided at the opposed portions of the rear outer handle and be inclined so as to extend gradually rearward toward the outside in the width direction of the vehicle. According to the invention, since the tapered portion is well matched to the appearance of a vehicle, there is no sense of incongruity. Therefore, the design of the entire vehicle is not spoiled, wherein the appearance of the vehicle can be improved. Furthermore, air resistance in running can be reduced.

A door outer handle structure according another aspect of to the invention involves a door outer handle structure provided in a vehicle having hinge type opening and closing front side doors and slide type opening and closing rear side doors, which includes: a front outer handle secured at the rear end edge of the front side door along the longitudinal direction of the vehicle; a rear outer handle provided at the front end edge of the rear side door to secure alignment with the front outer handle along the longitudinal direction of the vehicle and attached to the rear side door via a rear handle plate; a rear side swelling portion provided at the front end edge of the rear handle plate and swelling outward in the width direction of the vehicle from the rear side; and a hinge portion provided inwardly of the rear side swelling portion and rotatably supporting the front portion of the rear outer handle.

With such door outer handle structure according to the invention, since the hinge portion rotatably supports the front part of the rear outer handle, an operation of closing the rear side door can be facilitated. That is, since a passenger who gets out of the vehicle can turn the rear outer handle of the rear side door located rearward of the getting-out position as the passenger stands at the getting-out position, it is possible for the passenger to close the rear side door without moving rearward. Therefore, an operation of closing the rear side door can be easily carried out.

Further, since the hinge portion is provided inwardly of the rear side swelling portion formed so as to gradually swell outside in the width direction of the vehicle from the rear side at the front end portion of the rear handle plate, the hinge portion is positioned outside in the width direction of the vehicle in the interior of the door, wherein it is possible to thereby prevent the hinge portion from interfering with the door inner panel, etc. Therefore, interference between the hinge portion and the door inner panel, etc., can be prevented.

It is preferable that a door outer handle structure according to the invention be further provided with the front handle plate shaped so as to be continuous with the rear handle plate in the longitudinal direction, and the front outer handle is attached to the front side door via the front handle plate. According to the invention, the design of the entire vehicle is not spoiled, wherein the appearance of the vehicle can be further improved.

It is preferable that the door outer handle structure according to the invention be further provided with a front side swelling portion which is provided at the rear end portion of the front handle plate and is continuous to the rear side swelling portion by swelling outside from the front side in the width direction of the vehicle. According to the invention, a sense of continuity of the front side and rear side door, both of which are closed, is brought about, wherein the design of the entire vehicle is not spoiled, and the appearance of the vehicle is further improved.

In addition, since the rear side swelling portion and front side swelling portion are provided, a recess for operating the rear outer handle and recess for operating the front outer handle are provided to be separated from each other in the longitudinal direction. Therefore, the area occupied by the recesses can be narrowed, and the door surface is resultantly made smooth.

It is preferable that, in the door outer handle according to the invention, a key cylinder is provided inside the front side swelling portion. According to the invention, the inside of the front side swelling portion can be effectively utilized as an installation space of the key cylinder.

DETAILED DESCRIPTION OF THE INVENTION

A description is given below of a door outer handle structure according to one embodiment of the invention with reference to the drawings. Forward/rearward and left/right referred to in the following description indicate forward/rearward and left/right when a vehicle runs forward with the doors closed unless otherwise specified.

Figure 1:
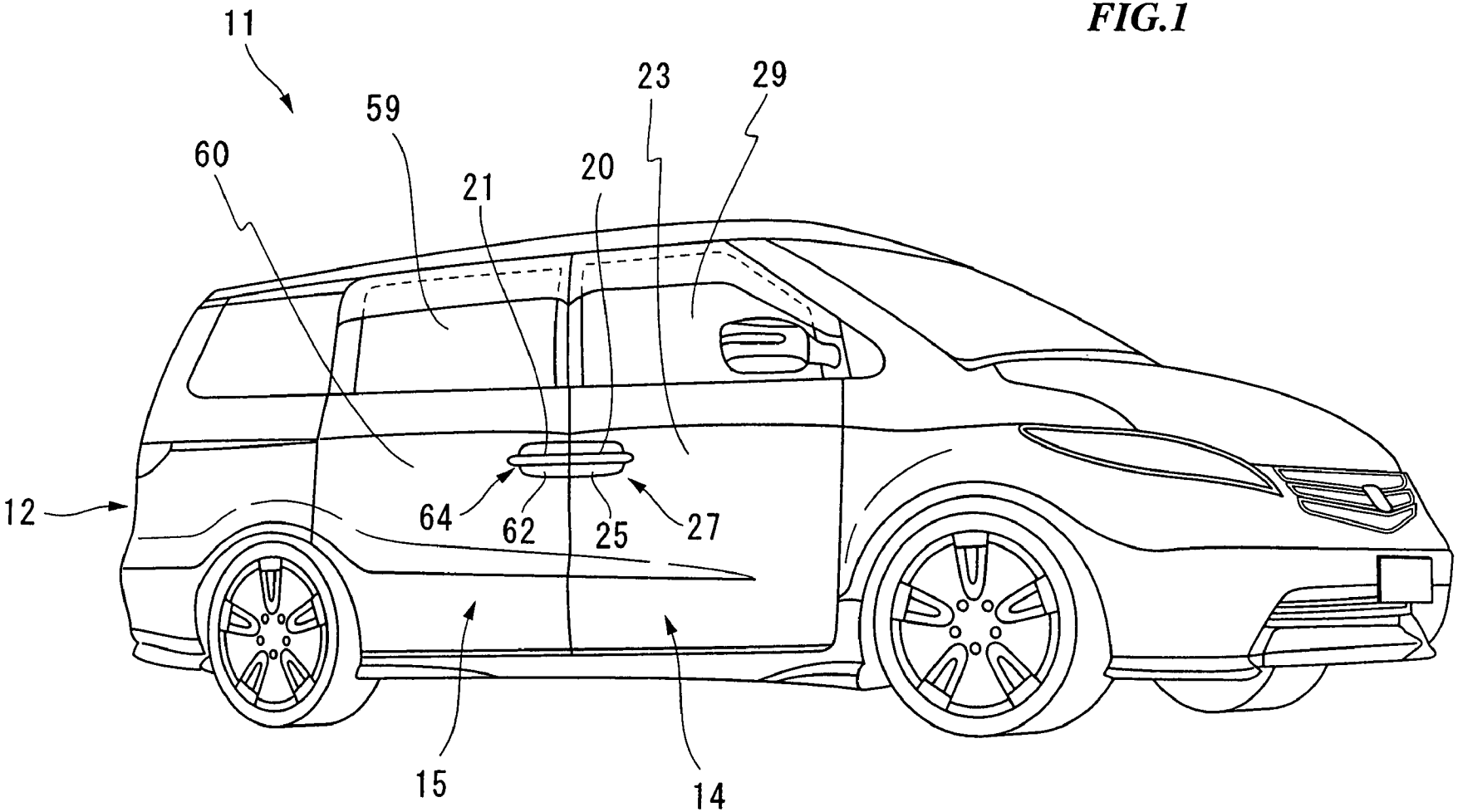
FIG. 1 is a perspective view showing a vehicle to which a door outer handle according to the invention is applied.

As shown in FIG. 1, a front side door 14 is provided at the front side of the side of a vehicle main body 12 in the vehicle 11, and a rear door 15 is provided at the rear side thereof. The front side door 14 is a hinge type opening and closing door, and the rear side is a power slide door driven by an electric motor. The front end of the front side door 14 is rotatably supported around the axis extending in the vertical direction in the vehicle main body 12. The rear side door 15 is slidably provided in the longitudinal direction in the vehicle main body 12. The rear side door 15 is opened by sliding rearward and is closed by sliding forward.

Figure 2:
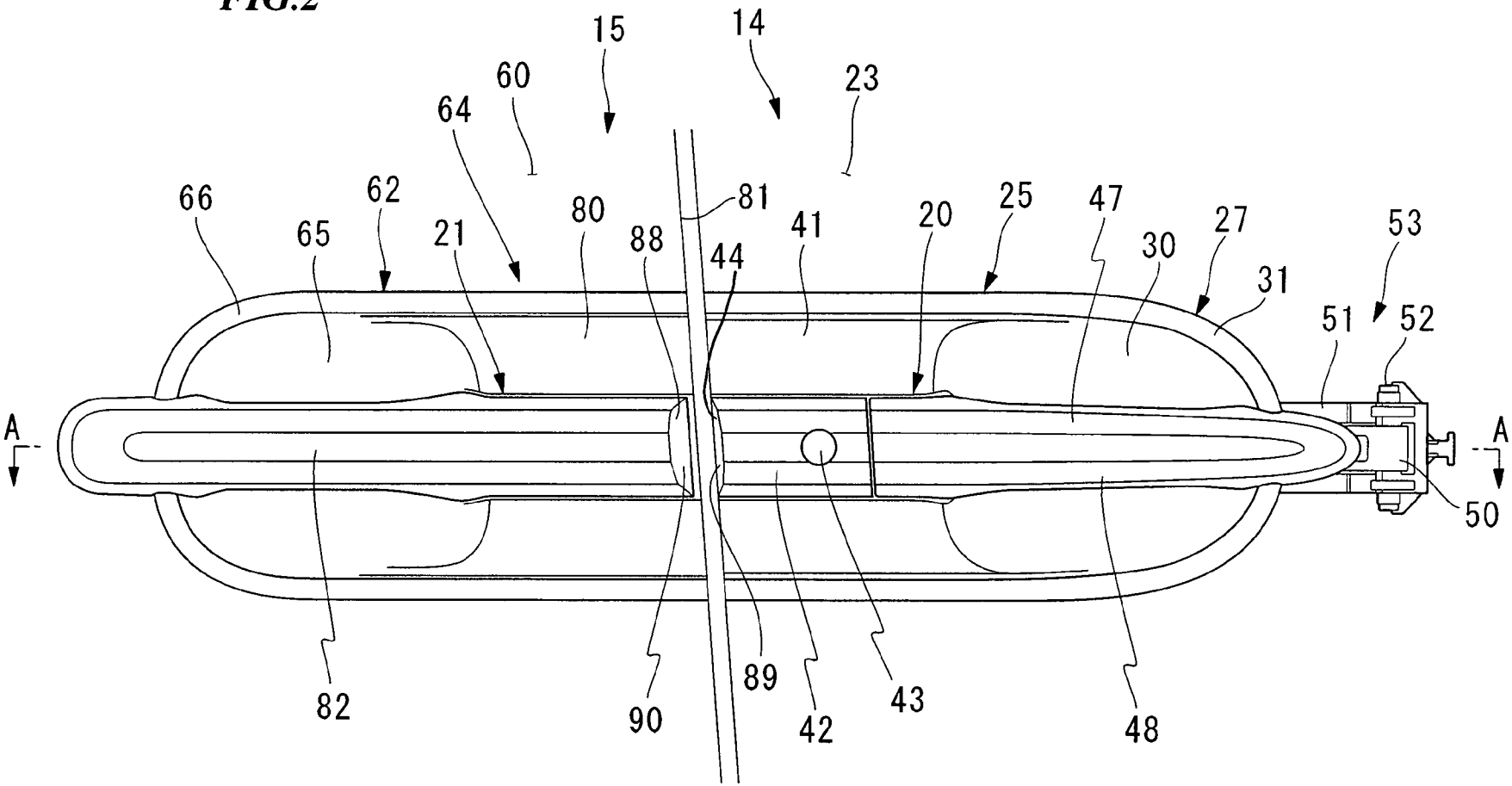
FIG. 2 is a front view of the door outer handle according to the invention.
Figure 3:
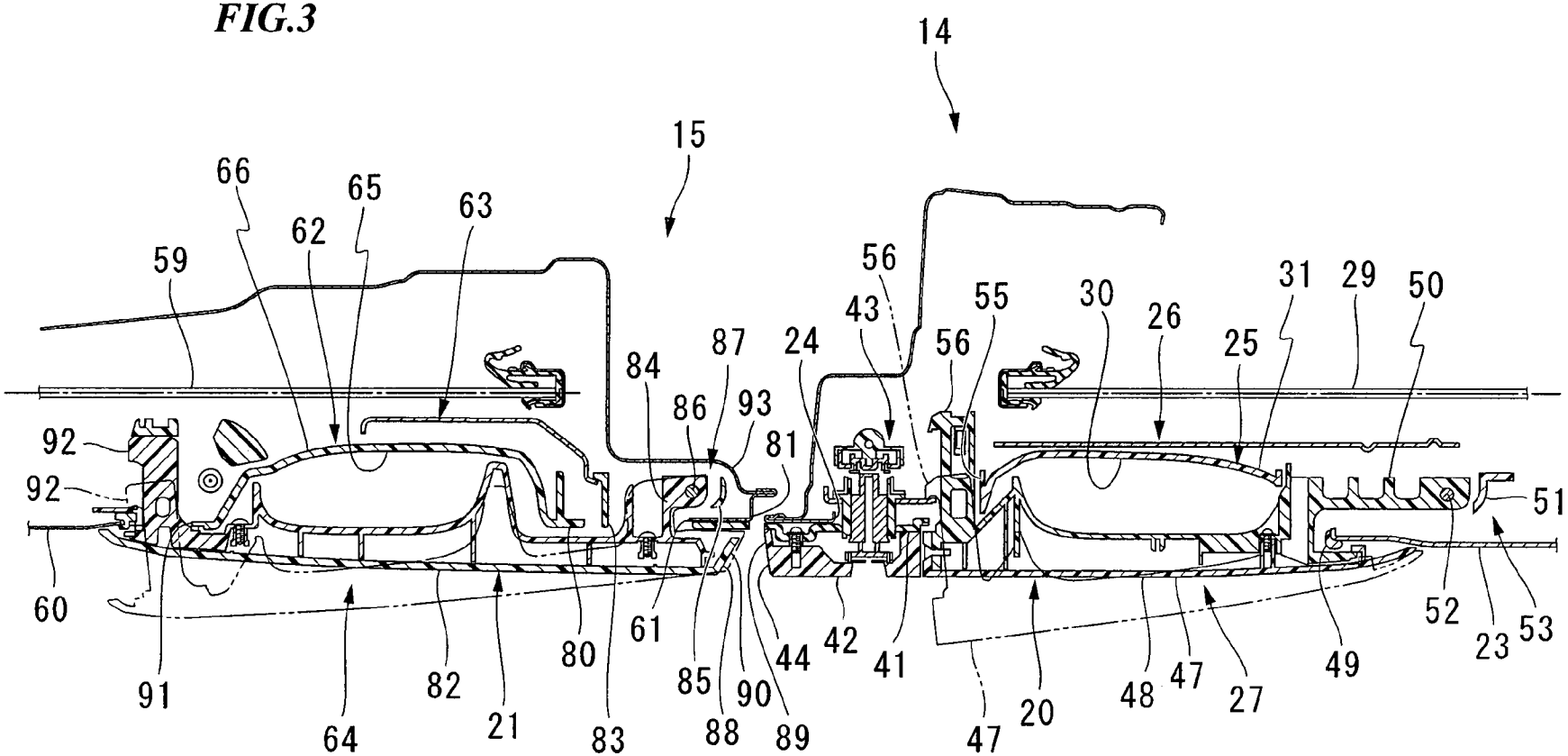
FIG. 3 is a sectional view taken along the line A—A in FIG. 2.
Figure 4:
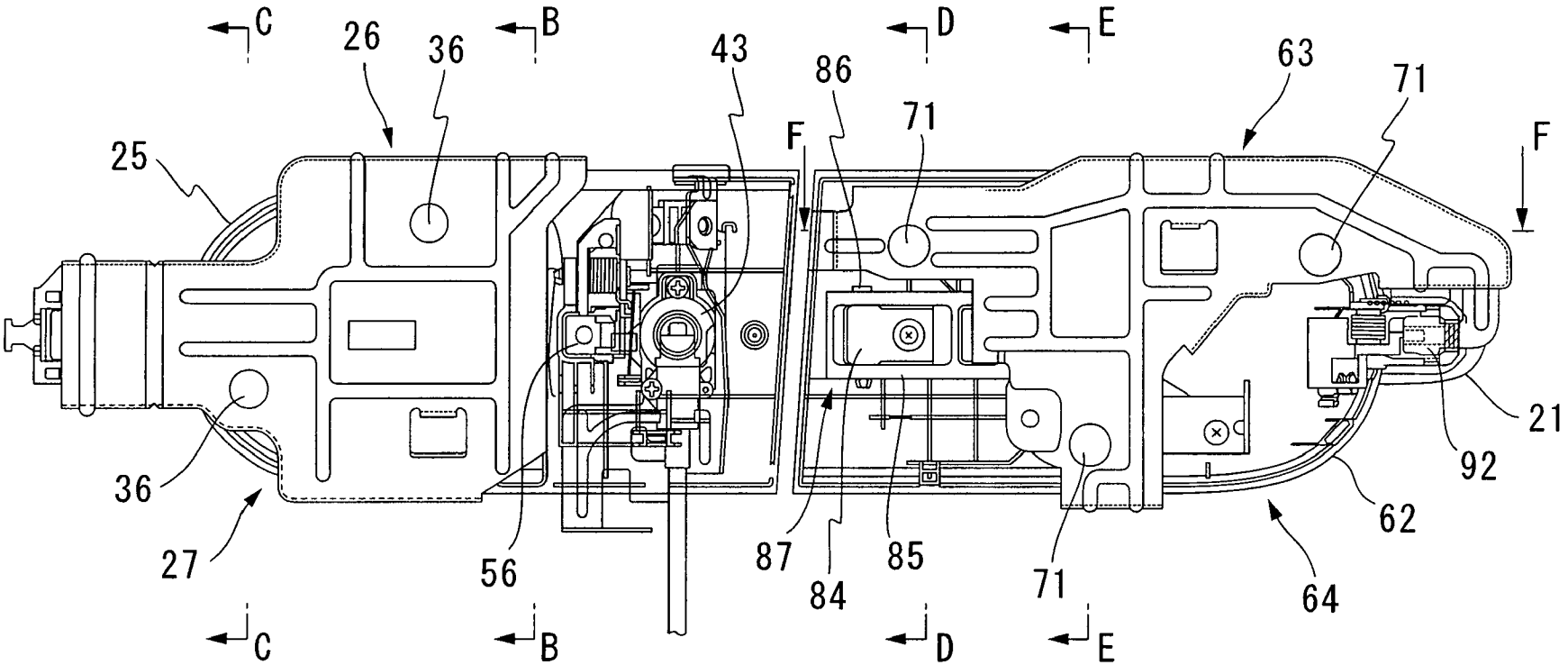
FIG. 4 is a back view of the door outer handle according to the invention.

As shown in FIG. 2 through FIG. 4, a front outer handle 20 for carrying out opening and closing operations of the front side door 14 is provided along the longitudinal direction at the rear end edge of the hinge type opening and closing front side door 14. A rear outer handle 21 for carrying out opening and closing operations of the rear side door 15 is provided along the longitudinal direction at the front end edge of the slide type opening and closing rear side door 15. When both the front side door 14 and rear side door 15 are closed, nothing exists between the front outer handle 20 and the rear outer handle 21, wherein the front outer handle 20 and rear outer handle 21 are made to approach each other and are in alignment in the longitudinal direction.

Figure 5:
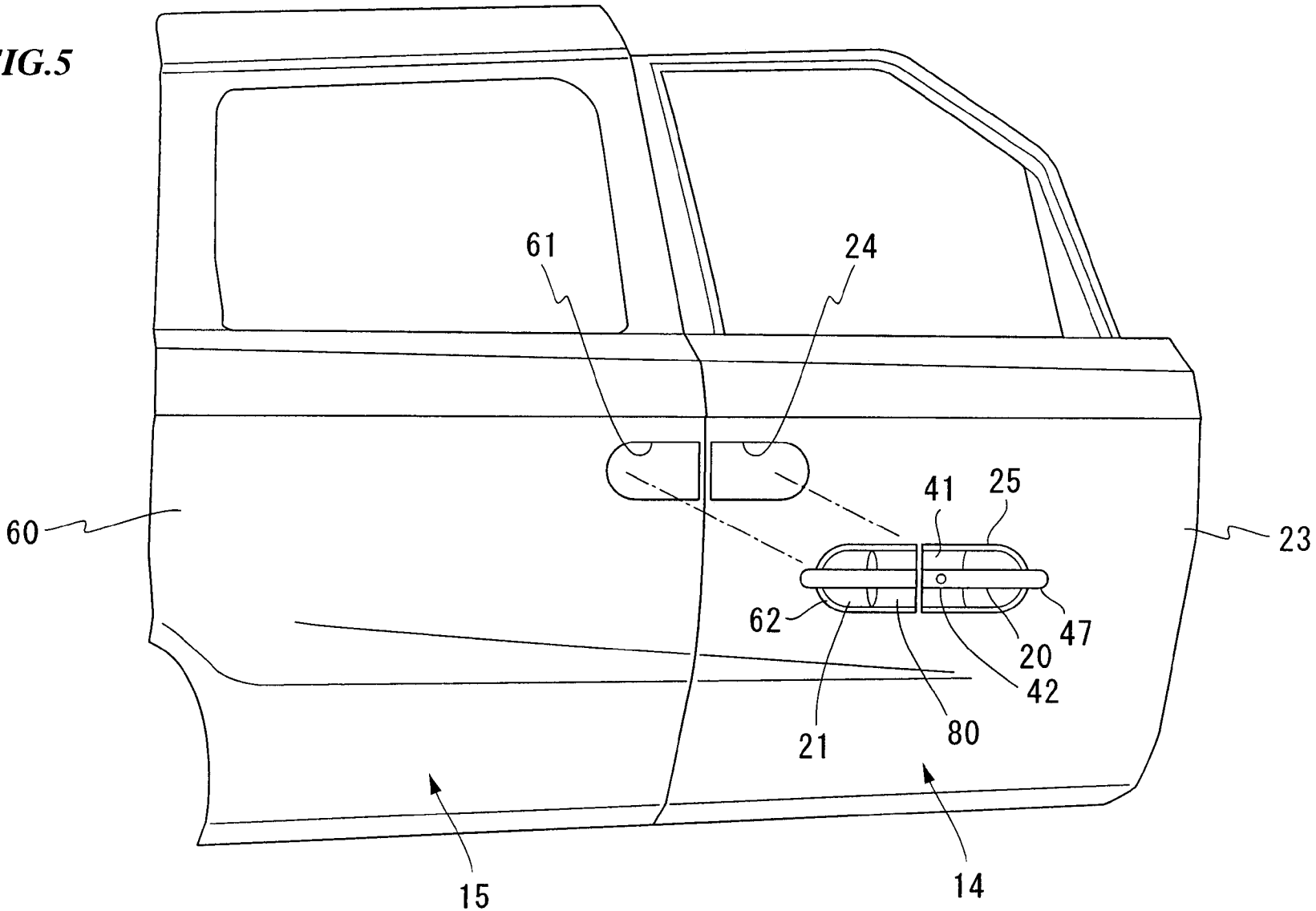
FIG. 5 is a disassembled perspective view of the door outer handle according to the invention.

As shown in FIG. 3 and FIG. 5, an opening 24 is formed in the vicinity of the rear end edge of a front door skin 23 which constitutes the outer surface of the front side door 14. The front outer handle 20 is attached to the front side door 14 via a front handle plate 25 fitted in the opening 24 and a metal-made front protector 26 fixed at the front handle plate 25. The front protector 26 is disposed inside the front door skin 23 in the width direction of the vehicle. The front handle plate 25 and front outer handle 20 are coupled to each other, and constitutes a front outer handle unit 27 composed mainly of synthetic resin.

As shown in FIG. 2 through FIG. 4, the front handle plate 25 of the front outer handle unit 27 is long in the longitudinal direction, comparatively wide in the vertical direction and is circular arc-shaped at its front part. The front handle plate 25 has a plate main body 31, and a recess part 30 dented inwardly in the vehicle width direction is formed at the front part of the plate main body 31. The recess part 30 is a relief in which fingers are turned in the back side of the front outer handle 20 when operating the front outer handle 20.

Figure 6:
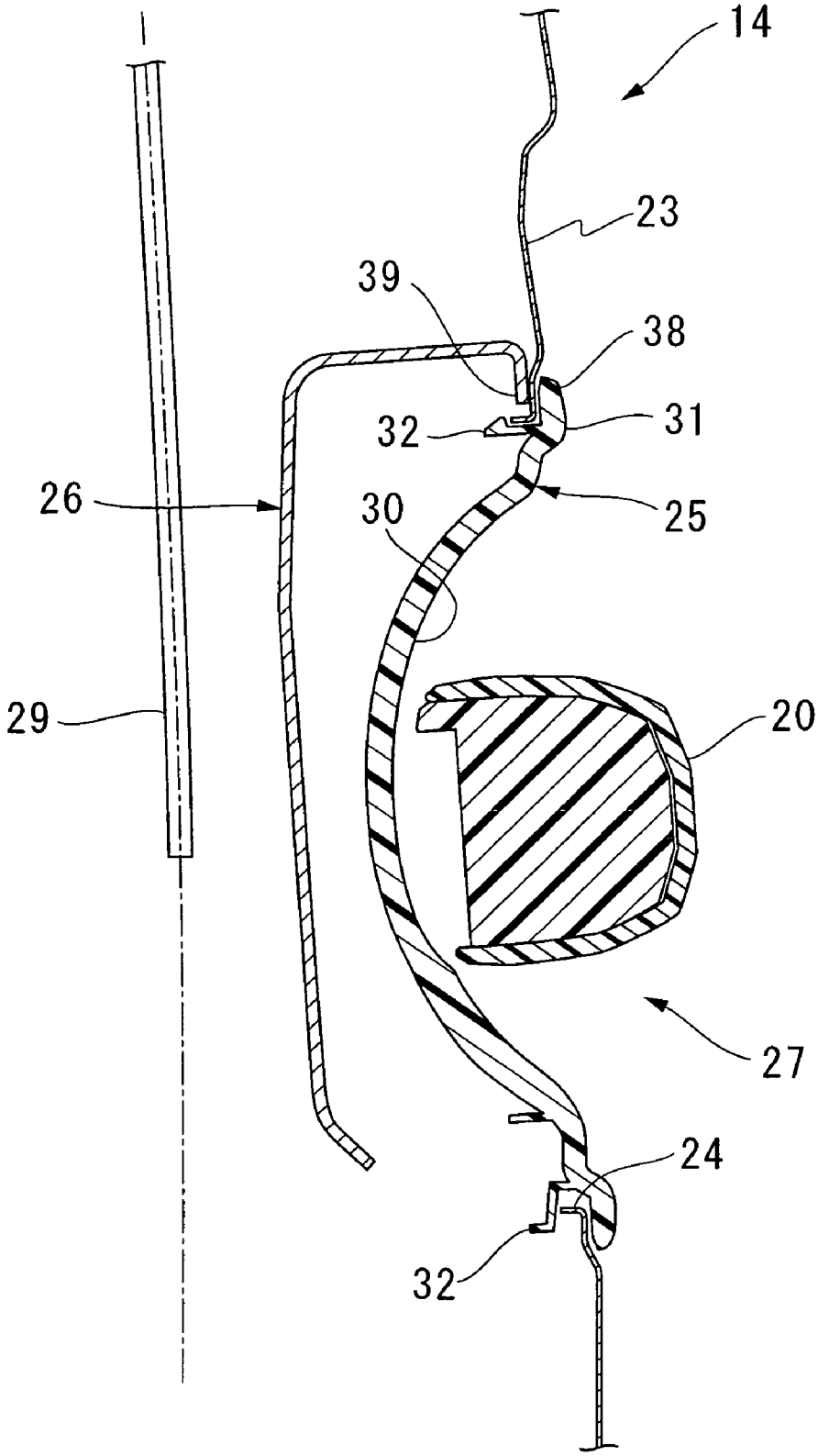
FIG. 6 is a sectional view taken along the line B—B in FIG. 4.

As shown in FIG. 6, a plurality of locking parts 32 are provided on the back surface of the front handle plate 25, that is, at the side opposed to the front outer handle 20 of the plate main body 31 (FIG. 6 shows only two locking parts 32; however, other locking parts are also provided). The locking parts 32 are engaged with the inner circumferential edge of the opening 24 of the front door skin 23. Here, in respective drawings, reference number 29 denotes window glass of the front side door 14.

Figure 7:
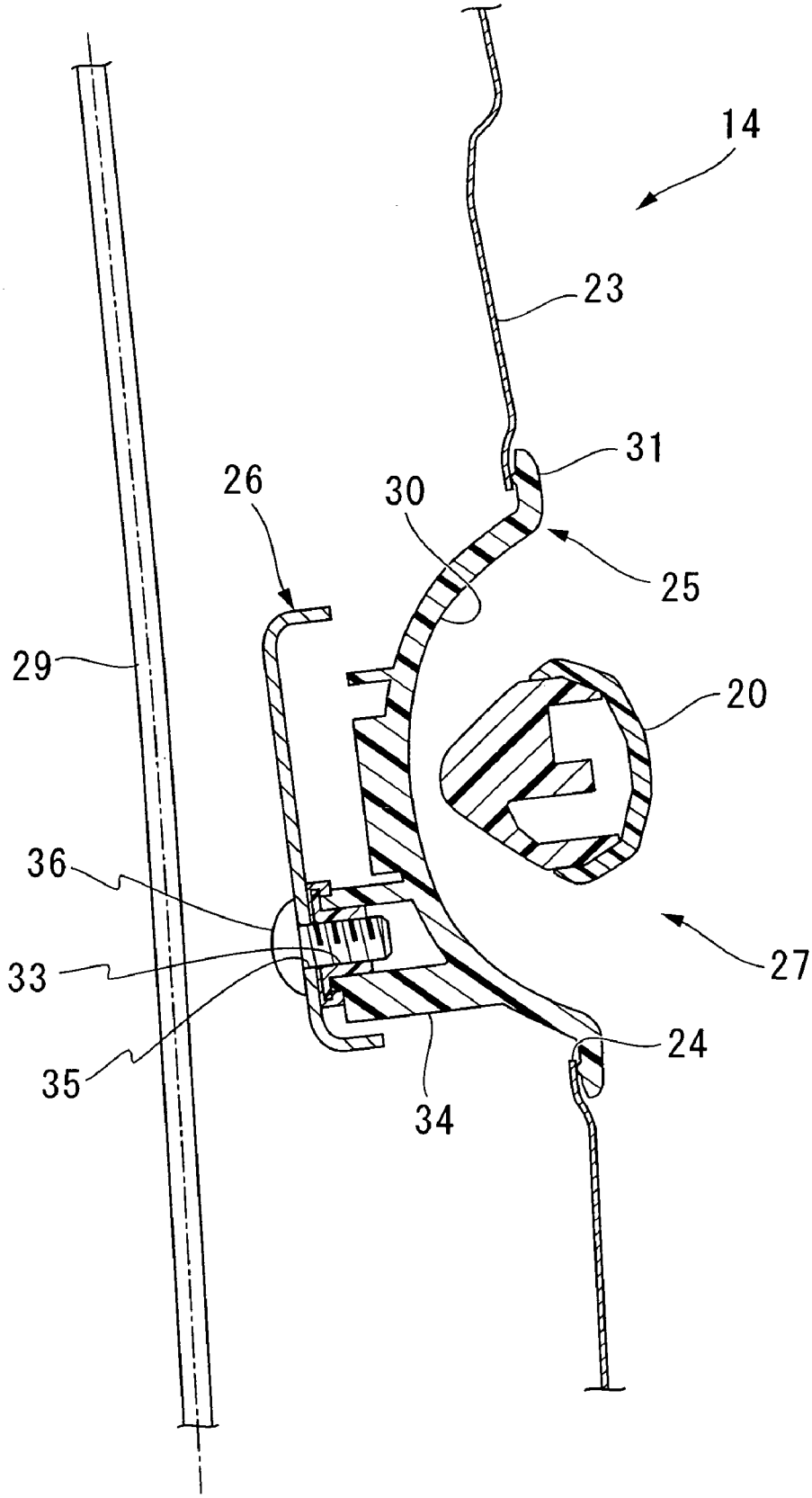
FIG. 7 is a sectional view taken along the line C—C in FIG. 4.

As shown in FIG. 7, a boss portion 34 is formed on the back surface of the plate main body 31. A collar 33 is fitted inside the boss portion 34. An attaching hole 35 is formed at the front protector 26 disposed inside the front door skin 23. The front protector 26 is attached to the plate main body 31 by inserting a screw 36 into the attaching hole 35 and screwing the screw 36 in the collar 33. Attaching of the front protector 26 by the screw 36 is carried out at a plurality of points, concretely, at two points as shown in FIG. 4. Thus, as shown in FIG. 6, the inner circumferential edge of the opening 24 of the front door skin 23 is placed between a holding portion 38 of the plate main body 31 and a holding plate portion 39 of the front protector 26. The front handle plate 25 is attached to the front door skin 23, by placing and holding the inner circumferential edge portion of the opening 24 at a plurality of points by means of the holding portion 38 and the holding plate portion 39, in a state where the front outer handle 20 is disposed outside in the vehicle width direction.

As shown in FIG. 2 and FIG. 3, the front side swelling portion 41 is formed at the rear part of the plate main body 31. The front side swelling portion 41 swells outwardly in the vehicle width direction from the front side recess 30, and is made almost flush with the front door skin 23 of the front side door 14. In addition, the front side swelling portion 41 extends to the rear end edge of the front door skin 23 of the front side door 14.

The front outer handle 20 of the front outer handle unit 27 has a block-shaped portion 42. The block-shaped portion 42 is made slightly long in the longitudinal direction, is fixed at the middle part in the vertical direction of the rear part of the front handle plate 25, and is projected outwardly in the vehicle width direction from the front side swelling portion 41.

The front outer handle 20 shown in the respective drawings is for the right seat side, a key cylinder 43 for locking and unlocking is disposed from the block-shaped portion 42 to the inside of the front side swelling portion 41 in the vehicle width direction. The rear end surface 44 of the block-shaped portion 42 is slightly inclined gradually forward toward the outside in the vehicle width direction. Here, the front outer handle unit 27 at the front left seat side is composed of a left/right inverted structure of the front outer handle unit 27 at the right seat side except that no key cylinder is provided.

The front outer handle 20 has an outer handle main body 47. The handle main body 47 is disposed at the front side of the block-shaped portion 42 so that it is aligned with the block-shaped portion 42 in the vertical direction, and is rotatably supported on the front handle plate. The outer handle main body 47 has a handle portion 48. The handle portion 48 extends in the longitudinal direction and has such a shape so as to become tapered toward the tip end thereof. A connection piece 50 is formed at the front part of the handle portion 48. The connection piece 50 extends inside in the vehicle width direction, is taken inwardly of the plate main body 31 in the vehicle width direction through the opening 49 formed in the recess 30, and further extends forward inside the plate main body 31. In line therewith, a supporting portion 51 extending forward from inside of the plate main body 31 is formed on the front handle plate 25. The outer handle main body 47 is supported at the tip end of the supporting portion 51 of the front handle plate 25. That is, the tip end of the connection piece 50 is attached to the tip end of the supporting portion 51 via a supporting axis 52 disposed along the vertical direction, and the outer handle main body 47 is rotatably supported around the supporting axis 52.

The handle portion 48 of the outer handle main body 47 is closest to the front side door 14 when being not operated as shown with solid lines in FIG. 3, and, when being operated with imaginary lines in FIG. 3, is turned around the supporting axis 52 and separated from the front side door 14. The supporting axis 52 and supporting portion 51 for supporting the supporting axis 52 compose a front hinge portion 53 for supporting the outer handle main body 47.

When the handle portion 48 is not operated, nothing exists between the handle portion 48 and the block-shaped portion 42, and the handle portion 48 and block-shaped portion 42 are made to approach to each other and are in alignment in the longitudinal direction. That is, the handle portion 48 and block-shaped portion 42 are made flush with each other at the outside portions in the vehicle width direction and at the positions in the vertical direction. Here, the front end edge of the outer handle main body 47 protrudes forward from the front end portion of the front handle plate 25.

An operation piece 56 is formed at the rear part of the handle portion 48. The operation piece 56 extends inwardly in the vehicle width direction and is brought in the inside of the plate main body portion 31 in the vehicle width direction through an opening 55. The operation piece 56 is to operate a latch mechanism (not illustrated) which is engaged with the vehicle body 12 in a state where the front side door 14 is closed.

When the handle portion 48 is not operated, the rear end portion of the outer handle main body 47 is closest to the front side door 14, wherein the amount of the operation piece 56 getting-into the front side door 14 is maximized. Furthermore, when the outer handle main body 47 is operated, the rear end portion of the outer handle main body 47 turns around the supporting axis 52 and is separated from the front side door 14, wherein the amount of the operation piece 56 getting into the front side door 14 is minimized. Thus, by causing the operation piece 56 to advance and retreat, the latch mechanism of the front side door 14 is operated. That is, when opening the closed front side door 14, for example, if a passenger grips and pulls the handle portion 48 of the outer handle main body 47, the outer handle main body 47 is turned to a predetermined angle, and the front side door 14 is disengaged by the latch mechanism. Moreover, if the handle portion 48 is further pulled, the front side door 14 turns around the front end and is opened.

As shown in FIG. 3 and FIG. 5, an opening 61 is formed in the vicinity of the front end edge of the rear door skin 60 that composes the outer surface of the rear side door 15. The rear outer handle 21 is attached to the rear side door 15 via a rear handle plate 62 fitted into the opening 61 and a metal-made rear protector 63 fixed at the rear handle plate 62. The rear protector 63 is disposed inside the rear door skin 60 in the vehicle width direction. The rear handle plate 62 and rear outer handle 21 are coupled to each other, and constitute a rear outer handle unit 64 composed mainly of synthetic resin.

As shown in FIG. 2 through FIG. 4, the rear handle plate 62 of the rear outer handle unit 64 is long in the longitudinal direction, comparatively wide in the vertical direction and circular arc-shaped at its rear end. The rear handle plate 62 has a plate main body 66, and a recess 65 dented inwardly in the vehicle width direction is formed at the rear part of the plate main body 66. The recess 65 is a relief where fingers are turned in the back side of the rear outer handle 21 when operating the rear outer handle 21.

Figure 8:
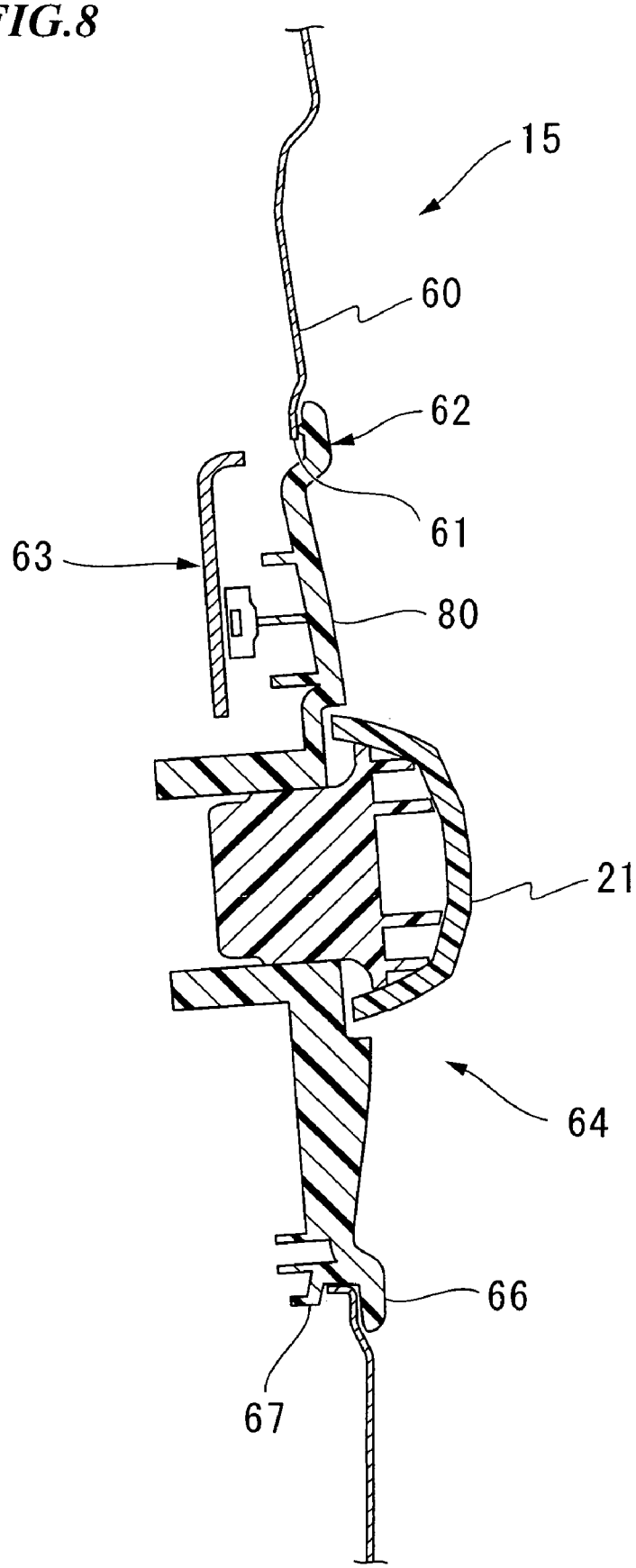
FIG. 8 is a sectional view taken along the line D—D in FIG. 4.

As shown in FIG. 8, locking members 67 are formed on the back side of the rear handle plate 62, that is, at the side opposed to the rear outer handle 21 of the plate main body 66. The locking members 67 are engaged in the inner circumferential edge of the opening 61 of the rear door skin 60. Here, in the respective drawings, reference number 59 denotes window glass of the rear side door 15.

Figure 9:
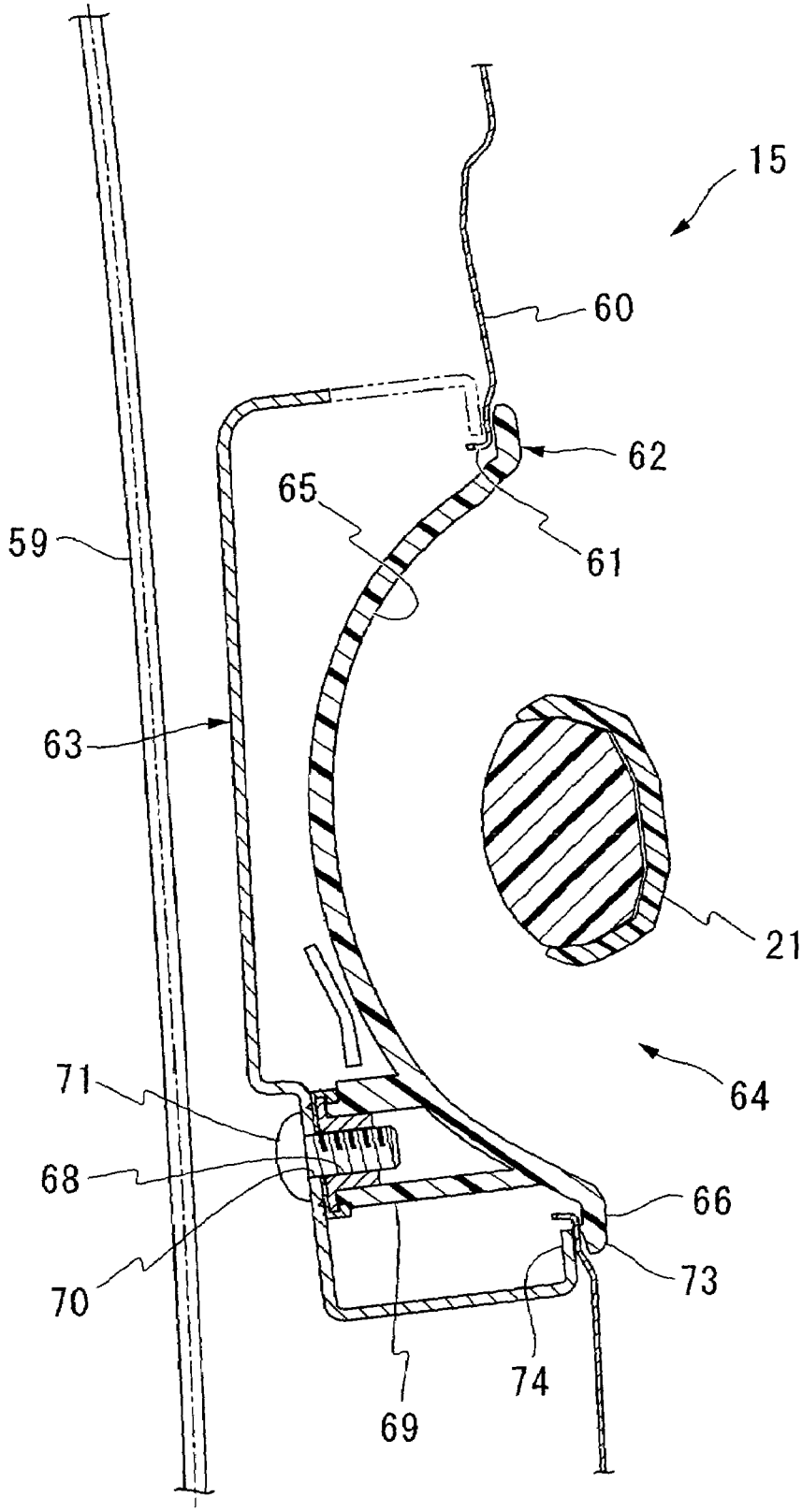
FIG. 9 is a sectional view taken along the line E—E in FIG. 4.
Figure 10:
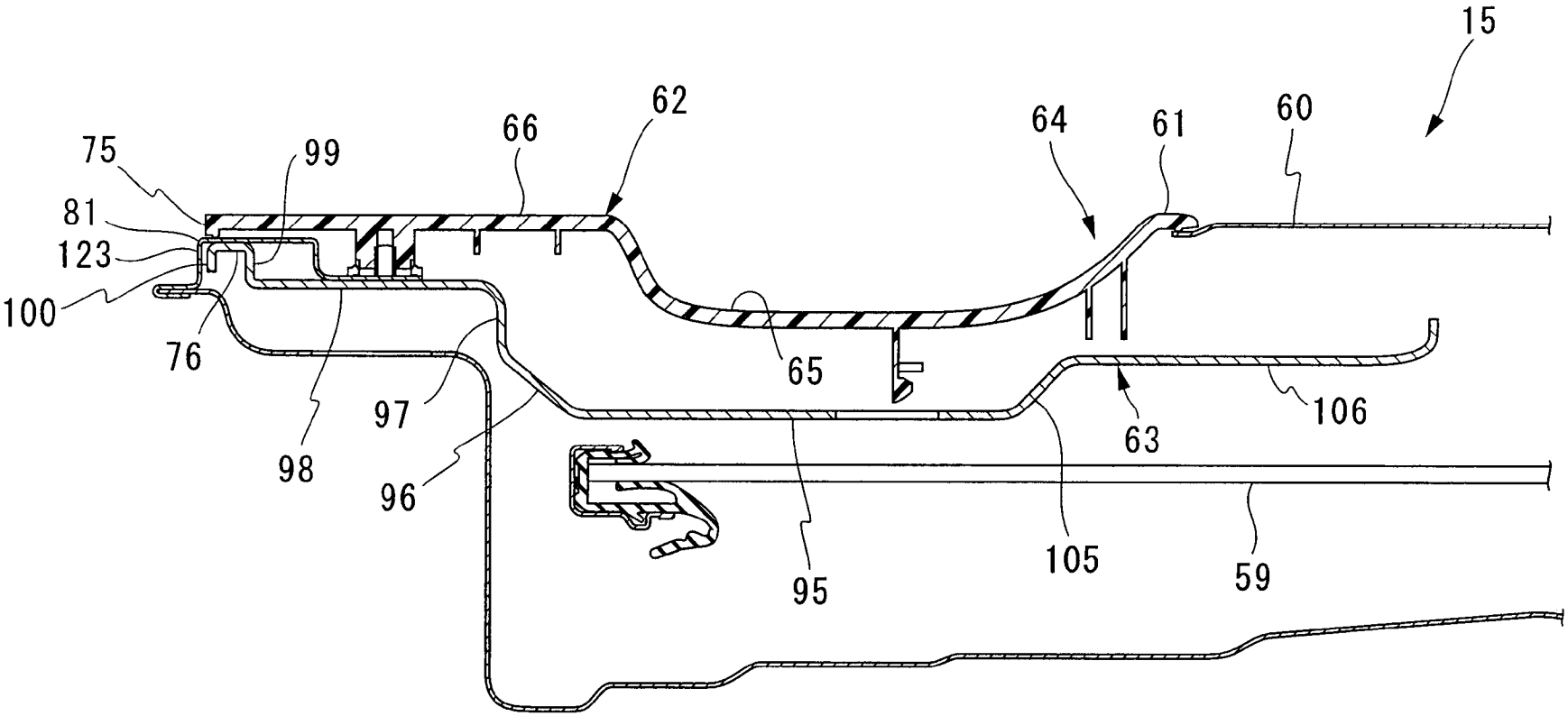
FIG. 10 is a sectional view taken along the line F—F in FIG. 4.

As shown in FIG. 9, a boss portion 69 is formed on the back surface of the plate main body portion 66. A collar 68 is fitted in the inside of the boss portion 69. An attaching hole 70 is formed on the rear protector 63 disposed inwardly of the rear door skin 60. The rear protector 63 is attached to the plate main body portion 66 by inserting a screw 71 into the attaching hole 70 and screwing the screw 71 in the collar 68. Attaching of the rear protector 63 by means of the screw 71 is carried out at a plurality of points, concretely, at three points as shown in FIG. 4. Thereby, as shown in FIG. 9, the inner circumferential edge of the opening 61 of the rear door skin 60 is placed between a holding portion 73 of the plate main body 66 and a holding plate portion 74 of the rear protector 63. In addition, as shown in FIG. 10, the rear door skin 60 is placed between another holding portion 75 of the plate main body portion 66 and another holding plate portion 76 of the rear protector 63. Since the opening 61 is held at a plurality of points between the holding portions and the holding plate portions, the rear handle plate 62 is attached to the rear door skin 60 in a state where the rear outer handle 21 is disposed outside in the vehicle width direction.

As shown in FIG. 2 and FIG. 3, a rear side swelling portion 80 is formed at the front part of the plate main body portion 66. The rear side swelling portion 80 swells outwardly in the vehicle width direction from the rear side recess 65, and is made almost flush with the rear door skin 60 of the rear side door 15. Also, the rear side swelling portion 80 extends to the outer parting line at the front end edge of the rear door skin 60 of the rear side door 15.

When both the front side door 14 and rear side door 15 are closed, the height and width of the rear handle plate 62 are coincident with those of the front handle plate 25 in the vertical direction. Furthermore, the positions of the outer surfaces, where both the handle plates 62 and 25 are made to approach each other, are coincident with each other in the vehicle width direction. Moreover, since the front handle plate 25 is provided at the rear end edge of the front side door 14 and the rear handle plate 62 is provided at the front end edge of the rear side door 15, the front handle plate 25 and the rear handle plate 62 are continuous in the longitudinal direction.

When both of the front side door 14 and the rear side door 15 are closed, the height and width of the rear side swelling portion 80 are coincident with those of the front side swelling portion 41 in the vertical direction. Furthermore, the positions of the outer surfaces, where both are made to approach each other, are coincident with each other in the vehicle width direction. Moreover, since the front side swelling portion 41 is provided at the rear part of the front handle plate 25, and the rear side swelling portion 80 is provided at the front part of the rear handle plate 62, the front side swelling portion 41 and the rear side swelling portion 80 are continuous in the longitudinal direction.

The rear outer handle 21 of the rear outer handle unit 64 is rotatably supported on the rear handle plate 62 and has a handle portion 82. The handle portion 82 extends in the longitudinal direction and is made circular arc-shaped at its rear end portion. A connection piece 84 is formed at the front part of the handle portion 82. The connection piece 84 extends inwardly in the vehicle width direction and is brought inwardly of the plate main body portion 66 in the vehicle width direction through an opening 83 formed in the rear side swelling portion 80. Further, it extends forward inside the rear side swelling portion 80. In line therewith, as shown in FIG. 4, a supporting portion 85 is formed inside the plate main body portion 66. The rear outer handle 21 is supported at the tip end of the supporting portion 85 of the rear handle plate 62. That is, the tip end of the connection piece 84 is attached to the tip end of the supporting portion 85 via a supporting axis 86 disposed along the vertical direction, and the rear outer handle 21 is rotatably supported around the supporting axis 86.

The handle portion 82 of the rear outer handle 21 is closest to the rear side door 15 when being not operated as shown with solid lines in FIG. 3, and, when being operated as shown with imaginary lines in FIG. 3, it turns around the supporting axis 86 and is separated from the rear side door 15. The supporting axis 86 and supporting portion 85 for supporting the supporting axis 86 compose a rear hinge portion 87 that supports the rear outer handle 21. The rear hinge portion 87 is provided inwardly of the rear side swelling portion 80 in the vehicle width direction.

As described above, the rear outer handle 21 is attached to the rear side door 15 via the rear handle plate 62 where the rear side swelling portion 80 is formed, and the connection piece 84 formed at the front part of the rear outer handle 21 is rotatably provided via the rear hinge portion 87. In addition, the rear outer handle unit 64 at the front passenger' side has a left/right inverted structure of the rear outer handle unit at the driver's side.

When both of the front side door 14 and the rear side door 15 are closed and are not operated, the height and width of the rear outer handle 21 are coincident with those of the front outer handle 20 in the vertical direction. Furthermore, the positions of the outer surfaces, where both of them are made to approach each other, are coincident with each other in the vehicle width direction. Moreover, since the front outer handle 20 is provided at the rear end edge of the front side door 14, and the rear outer handle 21 is provided at the front end edge of the rear side door 15, nothing exists between the front outer handle 20 and the rear outer handle 21, wherein the front outer handle 20 and rear outer handle 21 are made to approach each other and are arranged in alignment. Here, the front end surface 90 of the rear outer handle 21 is opposed to the rear end surface 44 of the front outer handle 20 in the longitudinal direction of the vehicle. Furthermore, the rear end edge of the rear outer handle 21 protrudes rearward from the rear end portion of the rear handle plate 62.

Figure 11:
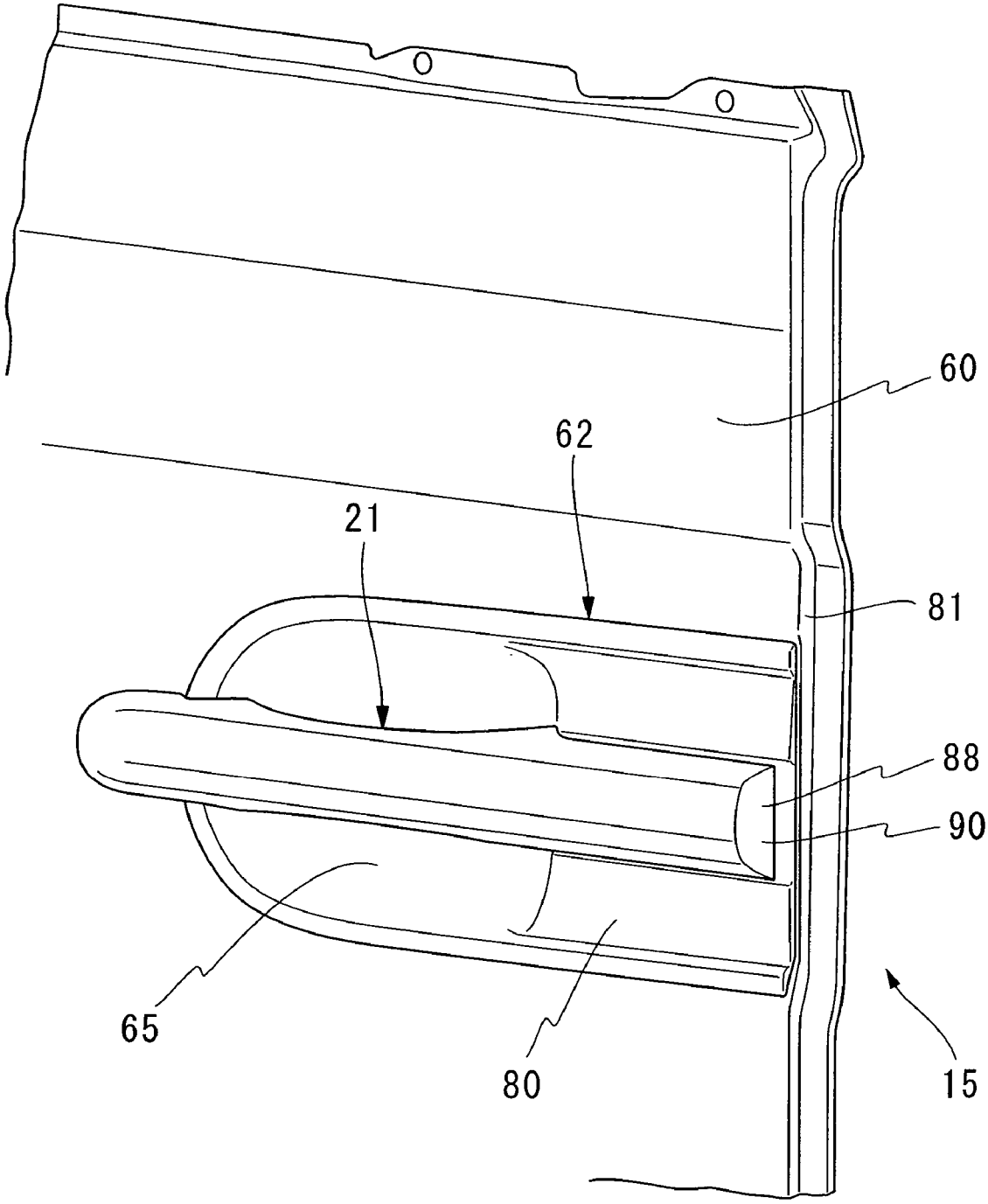
FIG. 11 is a perspective view showing the rear outer handle side of the door outer handle structure according to the invention.
Figure 12:
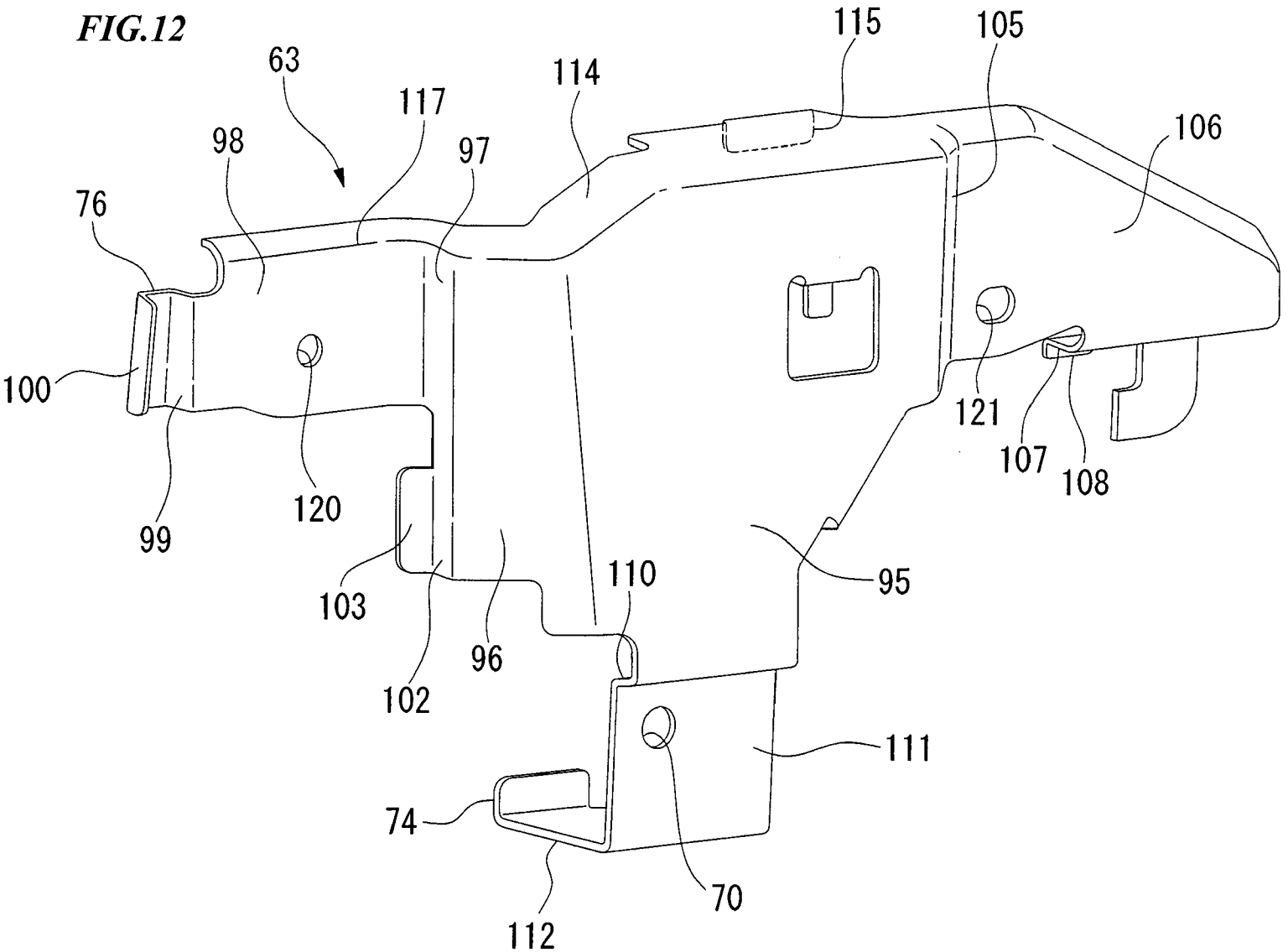
FIG. 12 is a perspective view showing a rear protector of the door outer handle structure according to the invention.
Figure 13:
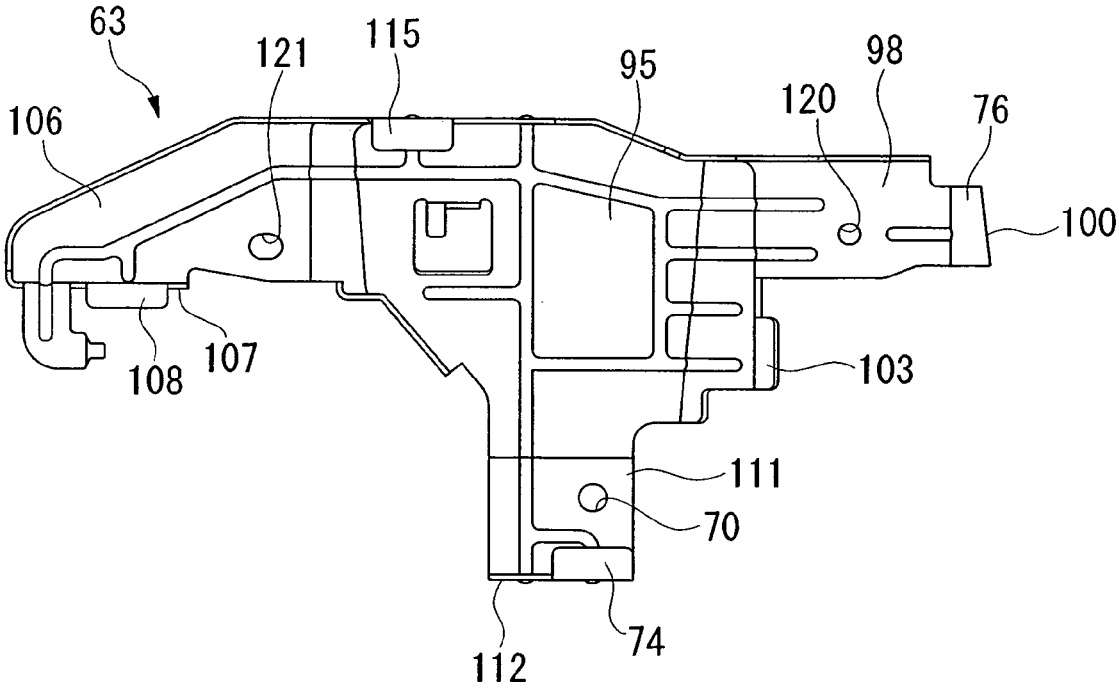
FIG. 13 is a back view showing the rear protector of the door outer handle structure according to the invention.
Figure 14:
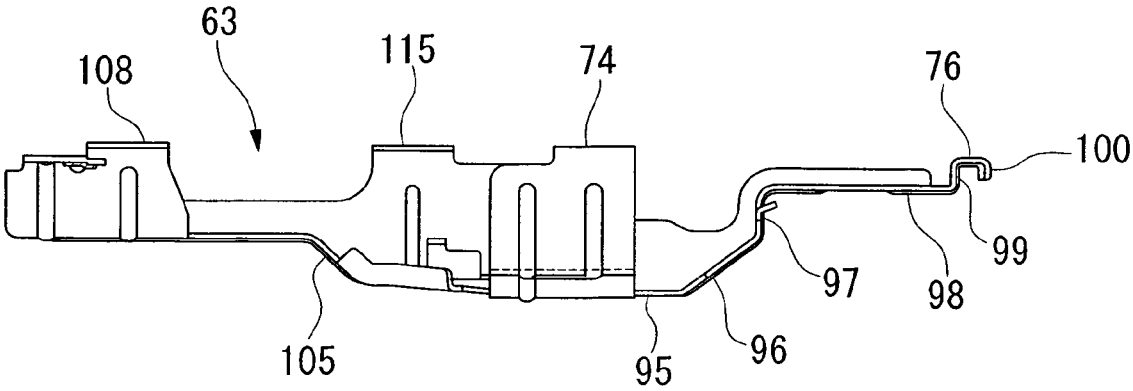
FIG. 14 is a view showing the rear protector of the door outer handle according to the invention when being observed from below.

As shown in FIG. 2, FIG. 3 and FIG. 11, a tapered portion (retraction portion) 88 is formed at the front end surface 90 of the rear outer handle 21. The tapered portion 88 is inclined so as to be positioned gradually rearward to the outside in the vehicle width direction when the rear side door 15 is closed and is not operated. Furthermore, a tapered portion (retraction portion) 89 is formed at the rear end surface 44 of the front outer handle 20. The tapered portion 89 is slightly inclined so as to be positioned gradually forward to the outside in the vehicle width direction when the front side door 14 is closed and is not operated. The rear end surface 44 and front end surface 90, that is, the tapered portions 88 and 89 are opposed to each other, and the gap between the tapered portions 88 and 89 is gradually widened toward the outside in the vehicle width direction. Here, the inclination of the front end surface 90 of the rear outer handle 21 is steeper than that of the rear end surface 44 of the front outer handle 20. Incidentally, for example, only the front end surface 90 of the rear outer handle 21 may be inclined.

As shown in FIG. 3, the operation piece 92 is formed at the rear part of the handle portion 82. The operation piece 92 extends inwardly in the vehicle width direction and is brought inwardly of the rear handle plate 62 in the vehicle width direction through the opening 91. The operation piece 92 is to operate the latch mechanism (not illustrated) which is engaged with the vehicle body 12 in a state where the rear side door 15 is closed.

When the rear outer handle 21 is not operated, the rear end portion of the rear outer handle 21 in closest to the rear side door 15, and the amount of the operation piece 92 getting into the rear side door 15 is maximized. Furthermore, when the rear outer handle 21 is operated, the rear end portion of the rear outer handle 21 turns around the supporting axis 86 and is separated from the rear side door 15, wherein the amount of the operation piece 92 getting into the rear side door 15 is minimized. Thus, by causing the operation piece 92 to advance and retreat, the latch mechanism of the rear side door 15 is operated, and a control unit of a power slide door (not illustrated) operates. That is, when the closed rear side door 15 is opened, for example, if a passenger grips the handle portion 82 of the rear outer handle 21 and pulls it, the rear outer handle 21 is turned by a predetermined angle, and the rear side handle 15 is disengaged by the latch mechanism. Moreover, the operation triggers to actuate the control unit and the electric motor then operate, whereby the rear side door 15 slides rearward and is opened. On the other hand, when the opened rear side door 15 is closed, for example, if a passenger grips the handle portion 82 of the rear outer handle 21 and pulls it, the rear outer handle 21 is turned by a predetermined angle, and the operation triggers to actuate the control unit and the electric motor then operates, whereby the rear side door 15 slides forward and is closed. It is a matter of course that the rear side door 15 can be manually opened and closed.

Next, a description is given of the rear protector 63 which is coupled to the rear outer handle unit 64 and is also disposed inwardly of the rear door skin 60 in the vehicle width direction. Here, it is assumed that the rear protector 63 is attached to the rear side door 15.

As shown in FIG. 10 and FIG. 12 through FIG. 14, the rear protector 63 includes an intermediate plate portion 95, an inclination plate portion 96, a protrusion plate 97, a forward extension plate portion 98, a protrusion plate portion 99, the above-described holding plate portion 76 and a front end plate portion 100. The intermediate plate portion 95 is formed at the intermediate part of the rear protector 63 and is made flat plate-shaped. The inclination plate portion 96 is inclined gradually outwardly in the vehicle width direction from the front end edge of the intermediate plate portion 95 facing forward. The protrusion plate portion 97 protrudes outwardly in the vehicle width direction from the upper part of the front end edge of the inclination plate portion 96. The forward extension plate portion 98 extends forward from the outside end edge in the vehicle width direction of the protrusion plate portion 97. The protrusion plate portion 99 protrudes outwardly of the front end edge of the forward protrusion plate portion 98 in the vehicle width direction. The holding plate portion 76 protrudes forward from the outside end edge portion of the protrusion plate portion in the vehicle width direction. The front end plate portion 100 protrudes inwardly in the vehicle width direction from the front end edge of the holding plate portion 76.

Furthermore, the rear protector 63 includes a protrusion plate portion 102 and a holding plate portion 103. The protrusion plate portion 102 protrudes outwardly in the vehicle width direction from the lower part of the front end edge of the inclination plate portion 96. The holding plate portion 103 protrudes forward from the outside end edge in the vehicle width direction of the protrusion plate portion 102.

Moreover, the rear protector 63 includes an inclination plate portion 105, a rearward extension plate portion 106, a protrusion plate portion 107, and a holding plate portion 108. The inclination plate 105 is gradually inclined outwardly in the vehicle width direction from the rear end edge of the intermediate plate portion 95 facing rearward. The rearward extension plate portion 106 is shaped so that the upper end portion thereof is made lower rearward, and extends rearward from the rear end edge of the inclination plate portion 105. The protrusion plate portion 107 protrudes outwardly in the vehicle width direction from the lower end edge of the rear part of the rearward extension plate portion 106. The holding plate portion 108 protrudes downward from the outside end edge of the protrusion plate portion 107 in the vehicle width direction.

In addition, the rear protector 63 includes a protrusion plate portion 110, a downward extension plate portion 111, an extension plate portion 112, and the above-described holding plate portion 74. The protrusion plate portion 110 protrudes outwardly in the vehicle width direction from the lower end edge of the intermediate plate portion 95. The downward extension plate portion 111 extends downward from the outside end edge of the protrusion plate portion 110 in the vehicle width direction. The extension plate portion 112 extends outwardly in the vehicle width direction from the lower end edge of the downward extension plate portion 111. The holding plate portion 74 protrudes upward from the outside end edge of the extension plate portion 112 in the vehicle width direction.

Furthermore, the rear protector 63 has an upper plate portion 114. The upper plate portion 114 is provided so as to be continuous from the upper end edge, where the forward extension portion 98 at the protrusion plate portion 97 side, protrusion plate portion 97, inclination plate portion 96, intermediate plate portion 95, inclination plate portion 105, and rearward extension plate portion 106 are continuous, to the rear end edge of the rearward extension plate portion 106 continued to the inclination plate portion 105, and is bent outwardly in the vehicle width direction. The holding plate portion 115 is formed in the upper plate portion 114 secured at the intermediate plate portion 95. The holding plate portion 115 protrudes downward from the outside end edge in the vehicle width direction. Since the upper plate portion 114 is formed at the rear protector 63, a folding line 117 is formed along the longitudinal direction of a vehicle at the upper end edge, where the forward extension plate portion 98 at the protrusion plate portion 97 side, protrusion plate portion 97, inclination plate portion 96, intermediate plate portion 95, inclination plate portion 105 and rearward extension plate portion 106 continuous, to the rear end edge of the rearward extension plate portion 106.

The attaching hole 70 into which the above-described screw 71 is inserted is formed on the downward extension plate portion 111. Furthermore, an attaching hole 120 into which the screw 71 is inserted is formed on the forward extension plate portion 98, and an attaching hole 121 into which the screw 71 is inserted is formed on the rearward extension plate portion 106. Here, the attaching hole 120, which is closest to the front end plate portion 100, of the attaching holes 70, 120 and 121 is made circular, wherein the screw 71 is fitted therein without any clearance. That is, the attaching hole 120 which is closest to the front end plate portion 100 is concurrently used as a positioning hole for positioning the rear protector 63 and rear outer handle unit 64 in the vertical and longitudinal directions. On the other hand, the attaching hole 121 is made into an ellipse which is slightly longer in the longitudinal direction, wherein a clearance is formed in the longitudinal direction although there is no clearance between the attaching hole 121 and the screw 71 in the vertical direction. Therefore, the attaching hole 121 is used for positioning the rear protector 63 and rear outer handle unit 64 only in the vertical direction. Although the attaching hole 70 is circular, the diameter thereof is larger than the diameter of the screw 71, wherein a clearance is formed between the attaching hole 70 and the screw 71 in the vertical and longitudinal directions.

The screws 71 are inserted into the attaching holes 70, 120 and 121, respectively, and if the respective screws 71 are tightened in the rear handle plate 62, the rear door skin 60 is placed and held between the holding plate portions 76, 103, 108 and 115 of the rear protector 63 and the rear handle plate 62, whereby the rear protector 63 is attached to the rear side door 15. Incidentally, although not illustrated, seals may be adhered to the outsides of the holding plate portions 76, 103, 108 and 115 in the vehicle width direction, respectively.

As shown in FIG. 10, since the holding plate portion 76 of the rear protector 63 is positioned between the opening 61 of the rear door skin 60 and the appearance parting line 81 at the front end, the front end plate portion 100 extends along a stage portion 123 bent inwardly in the vehicle width direction from the appearance parting line 81 at the front end edge side of the rear door skin 60, and is faced to the staged portion 123 in the longitudinal direction of a vehicle.

Furthermore, the rear outer handle unit 64 is fixed at the rear protector 63 via the attaching hole 120 near the front end plate portion 100.

Moreover, the rear protector 63 is positioned at the rear outer handle unit 64 by the attaching hole 120, which is closest to the front end plate portion 100, of the attaching holes 70, 120 and 121.

In addition, a folding line 117 extending in the longitudinal direction is formed in the vicinity of the front end plate portion 100 of the rear protector 63. The folding line 117 exceeds in the longitudinal direction of a vehicle in the range between the extreme front side attaching hole 120 and the extreme rear side attaching hole 121.

According to the embodiment described above, since the front part of the rear outer handle 21 is rotatably supported by means of the rear hinge portion 87, it is possible to improve maneuverability when closing the rear side door 15. That is, since a passenger gets out of a vehicle and turns forward the rear outer handle 21 of the rear side door 15 located rearward of the getting-out position, it is not necessary for the passenger to move rearward, and it becomes possible for the passenger to carry out a closing operation of the rear side door 15 while standing at the getting-out position. Furthermore, since the rear hinge portion 87 for supporting the front part of the rear outer handle 21 is provided inside the rear side swelling portion 80 formed so as to swell outwardly in the vehicle width direction from the rear side at the front part of the rear handle plate 62, the rear hinge portion 87 is located outside the interior of the door in the vehicle width direction. Therefore, it is possible to prevent the door inner panel 93, which is stage-like outside in the vehicle width direction in order to prevent interference with the pillar, from interfering with the rear hinge portion 87. Accordingly, maneuverability for closing the rear side door 15 can be improved, and at the same time, it is possible to prevent interference between the rear hinge portion 87 and the door inner panel 93.

Since the front outer handle 20 is attached to the front side door 14 via the front handle plate 25, which is continued to the rear handle plate 62 in the longitudinal direction, the design of the front and rear door handles can be further improved.

Since the front side swelling portion 41 which is continued to the rear side swelling portion 80 by swelling outwardly in the vehicle width direction from the front side of the front handle plate 25 is formed at the rear end portion of the front handle plate 25, a sense of continuity between the edges of both doors is not spoiled when the front side door 14 and rear side door 15 are closed. Therefore, the design thereof is made further excellent. In addition, since, on the basis of provision of the rear side swelling portion 80 and the front side swelling portion 41, the recess 65 to operate the rear outer handle 21 and the recess 30 to operate the front outer handle 20 are provided so as to be separated from each other in the longitudinal direction, the number of recesses can be further reduced, wherein flush surface on the door surfaces can be further secured.

The key cylinder 43 is provided inside the front side swelling portion 41, and the inside can be effectively utilized as an installation space of the key cylinder 43.

According to the embodiment, since the front part of the rear outer handle 21 is roratably supported, a hand can easily hang onto the front part of the rear outer handle 21 when carrying out a closing operation of the rear side door 15. However, since the tapered portion 89 is formed at the front outer handle 20 and the tapered portion 88 is formed at the rear outer handle 21, the gap between the rear end surface 44 of the front outer handle 20 and the front end surface 90 of the rear outer handle 21 opposed to the rear end surface 44 is widened outward in the vehicle width direction. Therefore, for example, even if overstroke occurs when carrying out a closing operation of the rear side door 15, a hand hanging onto the front part of the rear outer handle 21 can be prevented from being brought into collision with the front outer handle 20.

In addition, the tapered portion may be provided at least for any one of the rear end surface 44 and the front end surface 90. Also, not only the tapered shape but also a stepped shape and/or a recessed shape may be employed for the rear end surface 44 and the front end surface 90. However, it is preferable in view of improving the appearance that the tapered shape be employed, because the appearance is natural and the design is not spoiled.

In addition, in particular, if the tapered portion 88 inclined so as to be positioned rearward toward the outside in the vehicle width direction is formed at the front end surface 90 of the rear outer handle 21, the appearance is made further natural even if the gap between the rear end surface 44 and the front end surface 90 is widened to the outside in the vehicle width direction, wherein the design is not spoiled, further improving the appearance. In addition, air resistance in running can be reduced.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A door outer handle structure provided in a vehicle having a hinge type opening and closing front side door and a slide type opening and closing rear side door, comprising:

a front outer handle secured along the longitudinal direction of the vehicle at a rear end edge of the front side door;

a rear outer handle secured along the longitudinal direction of the vehicle at a front end edge of the rear side door so as to become flush with the front outer handle;

a hinge portion rotatably supporting a front part of the rear outer handle; and a retraction portion provided at least one of facing portions where the front outer handle and the rear outer handle are opposed to each other.

2. The door outer handle structure according to claim 1, wherein the retraction portion is a tapered portion provided at least one of facing portions.

3. The door outer handle structure according to claim 2, wherein the tapered portion is provided at the opposed portion of the rear outer handle, and is inclined so as to be extended gradually rearward to the outside in the width direction of the vehicle.

4. A door outer handle structure provided in a vehicle having a hinge type opening and closing front side door and a slide type opening and closing rear side door, comprising:

a front outer handle secured along the longitudinal direction of the vehicle at a rear end edge of the front side door;

a rear outer handle secured along the longitudinal direction of the vehicle at a front end edge of the rear side door so as to become flush with the front outer handle, and attached to the rear side door via a rear handle plate;

a rear side swelling portion provided at a front end portion of the rear handle plate and swelling outwardly in the width direction of the vehicle from a rear side thereof; and a hinge portion, provided inwardly of the rear side swelling portion, for rotatably supporting the front part of the rear outer handle.

5. The door outer handle structure according to claim 4, further comprising a front handle plate shaped so as to be aligned to the rear handle plate in the longitudinal direction of the vehicle;

wherein the front outer handle is attached to the front side door via the front handle plate.

6. The door outer handle structure according to claim 5, further comprising a front side swelling portion, provided at a rear end portion of the front handle plate, which extends longitudinally aligned to the rear side swelling portion by swelling outwardly in the width direction of the vehicle from a front side thereof.

7. The door outer handle structure according to claim 6, wherein a key cylinder is provided inside the front side swelling portion.

* * * * *